US008671725B2

(12) United States Patent
Nicoara

(10) Patent No.: US 8,671,725 B2
(45) Date of Patent: Mar. 18, 2014

(54) KEY AND LOCK ASSEMBLIES

(75) Inventor: Petrisor Nicoara, Ashkelon (IL)

(73) Assignee: Rav Bariach (08) Industries Ltd., Ashkelon (IL)

( * ) Notice: Subject to any disclaimer, the term of this patent is extended or adjusted under 35 U.S.C. 154(b) by 0 days.

(21) Appl. No.: 13/097,296

(22) Filed: Apr. 29, 2011

(65) Prior Publication Data

US 2012/0055212 A1 Mar. 8, 2012

Related U.S. Application Data

(63) Continuation-in-part of application No. 12/897,564, filed on Oct. 4, 2010.

(60) Provisional application No. 61/329,121, filed on Apr. 29, 2010.

(51) Int. Cl.
*E05B 27/00* (2006.01)
*E05B 19/02* (2006.01)

(52) U.S. Cl.
USPC ..... 70/395; 70/398; 70/399; 70/405; 70/406; 70/407; 70/409; 70/411

(58) Field of Classification Search
USPC ..... 70/395, 398, 399, 405–407, 409, 411
See application file for complete search history.

(56) References Cited

U.S. PATENT DOCUMENTS

| | | | | |
|---|---|---|---|---|
| 4,026,134 | A * | 5/1977 | Woolfson | 70/276 |
| 4,061,004 | A * | 12/1977 | Pappanikolaou | 70/491 |
| 4,380,162 | A * | 4/1983 | Woolfson | 70/276 |
| 5,085,062 | A * | 2/1992 | Capdevila | 70/276 |
| 5,784,910 | A * | 7/1998 | Eizen et al. | 70/395 |
| 5,799,519 | A * | 9/1998 | Hsiao | 70/358 |
| 6,490,898 | B1 * | 12/2002 | Mottura | 70/495 |
| 7,265,470 | B1 * | 9/2007 | Paden et al. | 310/156.43 |
| 2006/0048554 | A1 * | 3/2006 | Keller | 70/493 |
| 2011/0048084 | A1 * | 3/2011 | Tong | 70/491 |

FOREIGN PATENT DOCUMENTS

WO WO 2009147660 A2 * 12/2009

* cited by examiner

*Primary Examiner* — Suzanne Dino Barrett
*Assistant Examiner* — Ifeolu Adeboyejo
(74) *Attorney, Agent, or Firm* — Blue Filament Law PLLC; Avery N. Goldstein; Guy Levi

(57) ABSTRACT

The present invention is directed to key assemblies and their mating locks, and more particularly, to keys with mutually compressible, actuating elements capable of being continuously positioned axially within apertures in a key blade.

12 Claims, 14 Drawing Sheets

100
102
106
110
108
110
114
120
122
109
116
118
104
124

100
114
120
112

200
202
204
208
210
206
120
121
129
124
127
125
131
123
122

KEY AND LOCK ASSEMBLIES

RELATED APPLICATIONS

This application is a Continuation-in-part of co-pending U.S. application Ser. No. 12/897,564, filed on Oct. 4, 2010 claiming priority from U.S. Provisional Application No. 61/329,121, filed on Apr. 29, 2010 both which is incorporated herein by reference in their entirety.

FIELD OF THE INVENTION

The present invention relates generally to the field of keys, and more particularly, to keys with mutually compressible actuating elements.

BACKGROUND OF THE INVENTION

Embodiments of the present invention generally relate to entry security, and particularly to key assemblies and lock assemblies having elements capable of biasing locking pins and mechanical and design characteristics that substantially increase the number of key/lock combinations, thereby inhibiting the unauthorized replication of the key assembly.

Locks are often intended to provide the security of permitting only authorized ingress and/or egress for a given entry. The existence of a locked entry and/or the inability to unlock a locked entry may indicate that unauthorized passage through the entry is prohibited and/or to deter such unauthorized passage. Locking such entries may therefore control when, who, and/or what passes through the entry.

Various attempts may be made to gain unauthorized passage through a locked entry. For example, an individual lacking authorization may attempt to gain entry by breaking the door and/or breaking the lock. However, these actions suffer from many drawbacks, including, for example, the noise associated with breaking the door and/or lock, the resulting visual or audible indication that unauthorized ingress/egress may being occurring or has occurred, the potential need for tools to carry out the act of breaking the door and/or lock, and the time and energy associated with such a break.

Another option for unauthorized entry that may not involve some of the challenges associated with physically breaking the lock or door is duplicating the key that unlocks the lock, or use other devices in an attempt to manipulate, or pick, the lock so as to unlock the lock. Duplicating keys for many types of locks merely requires duplicating the general physical shape of the blade of the key, recreating the profile of key bits and the shape and depth of holes or cavities in the key. Such unauthorized duplication may be achieved by filing, cutting, and/or machining a blank of material, such as a key blank or other blank that is or can be machined or manipulated to suitably match the shape and configuration of the key.

Locks to an entry must, in addition to allowing authorized individuals to enter, have specific key profiles that prevent unauthorized key duplication, either by an unauthorized entrant or an unauthorized professional assembling the duplicate key. Additionally, a variety of top-secret institutions require keys with more combinations that are difficult to duplicate in order to avoid unauthorized entry.

Present day flat blade keys often have depressions of different depths in the key blade or, in the cases of high-security entry, have holes that are of different shapes. Additionally, there are keys having a variety of shapes, such as round cross-sectioned keys; and keys having outward projecting bits; all for the purpose of preventing unauthorized entry and/or unauthorized key duplication.

Thus, a need exists for key assemblies configured to prevent or deter successful unauthorized duplication of the key assembly. Further, a need exists to provide a key assembly that has mechanical properties and design requirements that increase the possible key/lock combinations that would inhibit unauthorized successful duplication of the key assembly, and thereby provide increased security against unauthorized ingress or egress through an entry.

BRIEF SUMMARY OF THE INVENTION

According to an aspect of the invention, a key assembly is provided that comprises a key blade, the key blade having a first surface and a second surface, the key blade configured to be inserted into a mating lock; an aperture in the key blade, the aperture having an axis; a cap having an outer surface, captured in the aperture for continuous axial travel between a first limit extending out of the first surface and a second limit recessed within the aperture; and a base having an outer surface, captured in the aperture for continuous axial travel between a first limit extending out of the second surface and a second limit recessed within the aperture; wherein the base is biased away from the cap.

According to another aspect of the invention, a key assembly is provided wherein the key is positioned in a lock assembly, the key assembly, comprising: a key blade, the key blade having a first surface and a second surface, the key blade configured to be inserted into the lock; an aperture in the key blade, the aperture having an axis; a cap having an outer surface, captured in the aperture for continuous axial travel between a first limit extending out of the first surface and a second limit recessed within the aperture; and a base having an outer surface captured in the aperture for continuous axial travel between a first limit extending out of the second surface and a second limit recessed within the aperture; wherein the base is biased away from the cap; the lock assembly having a barrel, a column extending from the barrel, and a cylinder configured to rotate within the barrel, the cylinder including a guide way; the column having an aperture configured to receive the sliding movement of a first pin housing, the first pin housing configured to receive the sliding movement of a first pin; the cylinder including a cylinder aperture configured to receive the sliding movement of a second pin housing, the second pin housing configured to receive the sliding movement of a second pin, the first pin being inwardly biased against the second pin so as to place the first pin in the cylinder aperture when the key assembly is not positioned in the lock assembly; the key assembly configured to outwardly bias and move the cap or the base against the first pin when the key assembly is positioned in the lock assembly so that the second pin and the second pin housing are located inside the cylinder and the first pin and first pin housing are located outside of the cylinder.

Additionally, according to another aspect the invention provides, in combination, a key assembly comprising: a key blade, the key blade having a first surface and a second surface, the key blade configured to be inserted into a mating lock; an aperture in the key blade, the aperture having an axis; a cap having an outer surface, captured in the aperture for continuous axial travel between a first limit extending out of the first surface and a second limit recessed within the aperture; and a base having an outer surface captured in the aperture for continuous axial travel between a first limit extending out of the second surface and a second limit recessed within the aperture; wherein the base is biased away from the cap; and a mating lock assembly, the lock assembly having a barrel, a column extending from the barrel, and a cylinder configured to rotate within the barrel, the cylinder including a guide way; the column having an aperture configured to receive the sliding movement of a first pin housing, the first pin housing configured to receive the sliding movement of a first pin; the cylinder including a cylinder aperture configured to receive the sliding movement of a second pin housing, the second pin housing configured to receive the sliding movement of a second pin, the first pin being inwardly biased against the second pin so as to place the first pin in the cylinder aperture when the key assembly is not positioned in the lock assembly; the key configured to outwardly bias and move the cap or the base against the first pin when the key assembly is positioned in the lock assembly so that the second pin and the second pin housing are located inside the cylinder and the first pin and first pin housing are located outside of the cylinder.

BRIEF DESCRIPTION OF SEVERAL VIEWS OF THE DRAWINGS

The present invention will be understood and appreciated more fully from the following detailed description, taken in conjunction with the drawings in which.

The foregoing summary, as well as the following detailed description of the preferred embodiments of the present invention, will be better understood when read in conjunction with the appended drawings. For the purpose of illustrating the preferred embodiments of the present invention, the drawings depict embodiments that are presently preferred. It should be understood, however, that the present invention is not limited to the arrangements and instrumentality shown in the attached drawings.

DETAILED DESCRIPTION OF THE INVENTION

Figures 1, 2, 3A, 3B:
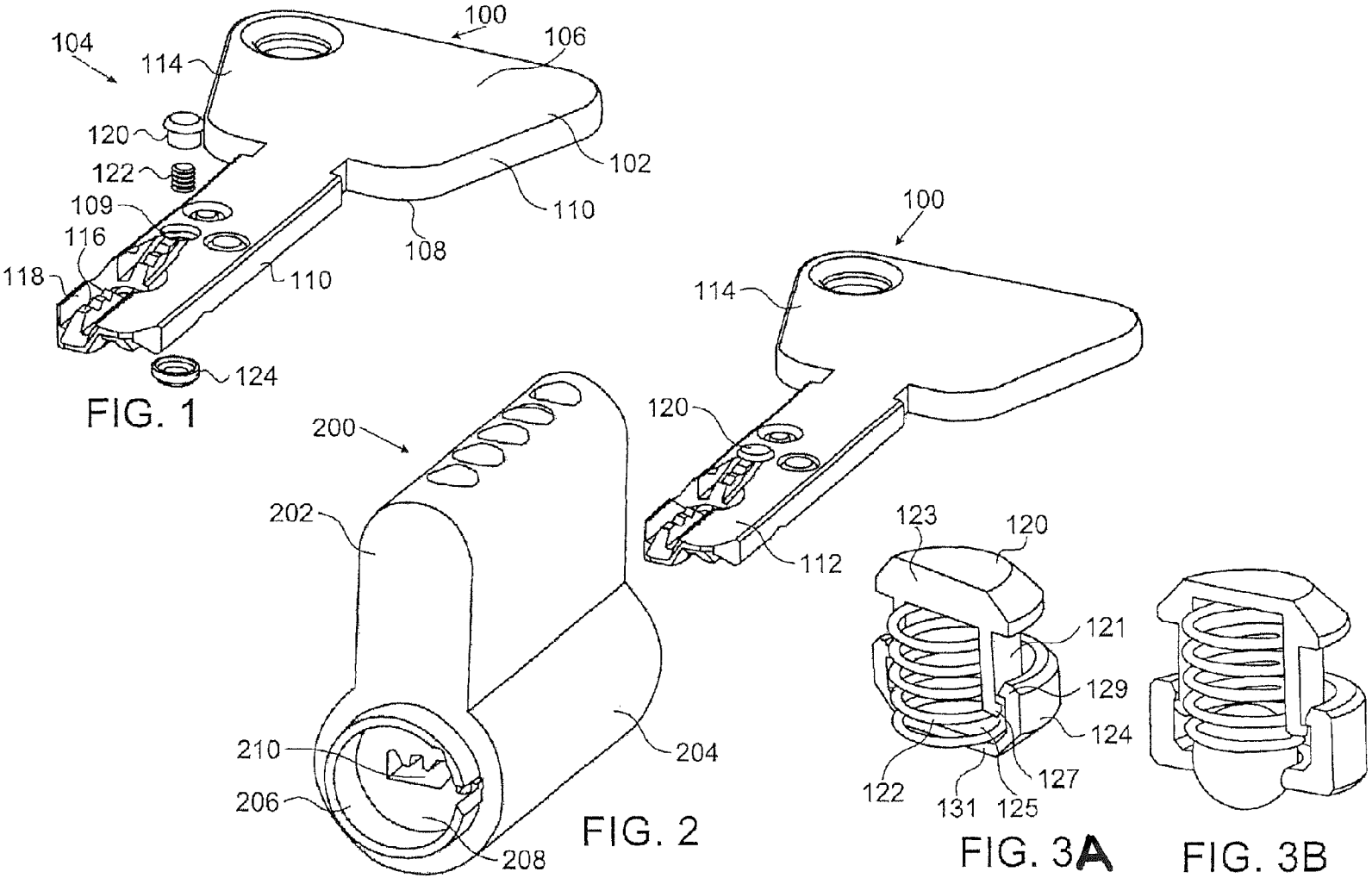
FIG. 1 illustrates an exploded view of a key assembly according to an embodiment of the present invention.
FIG. 2 illustrates a perspective view of a key assembly and a lock assembly according to an embodiment of the present invention.
FIG. 3A illustrates a cross sectional view of the actuation element shown in FIG. 1 according to an embodiment of the present invention.
FIG. 3B illustrates another embodiment containing a ball.

FIG. 1 illustrates an exploded view of a key blade (112), the key blade (112) having a first surface (106) and a second surface (108), the key blade configured to be inserted into a mating lock; an aperture (109) in the key blade (112), the aperture having an axis; a cap (120) having an outer surface (123, FIG. 3A), captured in the aperture (109) for continuous axial travel between a first limit extending out of the first surface (106) and a second limit recessed within the aperture (109); and a base (124) having an outer surface (131), captured in the aperture (109) for continuous axial travel between a first limit extending out of the second surface (108) and a second limit recessed within the aperture (109); wherein the base (124) is biased away from the cap (120). The key blade 112 may have various different general shapes and sizes, such as, for example, having a generally rectangular, cylindrical, square, triangular, or trapezoidal cross-section, among others.

The blade 112 may also include recesses and protrusions forming one or more outwardly projecting key bit 116. The key bit 116 may be located at various locations along the blade 112, including for example along the sides 110, first or second surfaces 106, 108, or in one or more key guide ways 118 in the blade 112. The key blank 102 may be constructed from a variety of different resilient materials, such as, for example, metallic materials, including, but not limited to, metal, brass, bronze, stainless steel, or a combination thereof.

FIG. 2 illustrates a perspective view of a key assembly 100 and a lock assembly 200 according to an embodiment of the present invention. The lock assembly 200 includes a column 202 and a barrel 204. The barrel 204 includes a drum 206 that houses and permits the rotational movement of a cylinder 208. The cylinder 208 includes a lock guide way 210 that is configured to receive the insertion and position mating key blade 112 of the key assembly 100. For example, the shape of the lock guide way 210 may be similar to that of the cross-sectional shape of the blade 112 and may include recesses, grooves, or other characteristics that generally complement and mate with those of the key blade 112.

FIG. 3A illustrates a cross sectional view of an actuation element 104 according to an embodiment of the invention shown in FIG. 1. The actuation element may include a cap 120 having an outer surface, a base 124 having an outer surface, wherein the cap 120 is biased away from the base 124 with the aid of a biasing means 122 such as a spring in one embodiment, or an elastic material, in another embodiment, or an identical-pole facing magnets, foam rubber, elastic cones or other similar mechanisms for biasing the cap 120 from the base 124. According to one embodiment, the biasing means 122 may be a spring. However, different embodiments of the present invention allow for the use of different actuators, such as, for example, magnets and air pressure, or a combination thereof. The spring actuator 122 shown in FIGS. 3A (and 3B) may provide a biasing force that may allow for the continuous altering in the linear distance between an upper portion of the cap 120 and the base 124, regardless of whether the cap 120 or the base 124 is anchored by the aperture 109 in one embodiment, or the lock guide way 210 in another embodiment. For example, when the biasing means 122 is a spring, when the spring is extended, the distance between the upper surface portion of the cap 120 and the base 124 is greater than if the spring was compressed.

According to the embodiment illustrated in FIG. 3A, the cap 120 and base 124 may be configured to provide a sliding engagement that allows for the continuous relative movement of the cap 120 and/or base 124 relative to each other. For example, the cap 120 may include at least one lower protrusion 121 that extends downwardly from an upper portion 123 of the cap 120. At least a portion of the lower protrusion 121 may be configured to be received in a bore 125 of the base 124. The lower protrusion 121 may include outwardly extending tabs 127 that mate with inwardly extending lips 129 of the base 124 that, in one embodiment retain the cap 120 and base 124 in a sliding engagement. Moreover, upper portion of the cap 123, the lower protrusion 121 and the inwardly extending base lips 129 define a channel capable of being captured by the aperture 109 positioned in key blade's 112. Further, this engagement assists in another aspect, in retaining the biasing means 122 within the actuation element 104, as shown in FIG. 3A. Therefore, in one embodiment, when the actuation element 104 attempts to extend the distance between an upper portion of the cap 120 and the base 124, the inwardly extending lips of the base 124 and the outwardly extending tabs of the cap 120 provide interference that prevents the cap 120 from separating from the base 124. The position of the tabs 127 and/or lips 129 may thus limit the distance the cap 120 may be biased away from the base 124, the base 124 may be continuously biased away from the cap 120 and/or the cap 120 and the base 124 may be biased away from each other. Further, the tabs 127 and lip 129 may limit the distance the cap 120 and/or base 124 may extend from the first or second surface 106, 108. In one embodiment, a shelf 111 extending radially inside the aperture 109 engages the channel created by upper portion of the cap 123, the lower protrusion 121 and the inwardly extending base lips 129, thereby limiting the continuous axial motion of the element 104, between predetermined limits above surface 106 and below surface 108. In one embodiment, element 104 may freely and continuously move from a position wherein the cap 120 extends about 1 mm above surface 106, to a position in which the base 124 extends about 1 mm below surface 108. In one embodiment, the element 104, is referred to as floating, or a floating element, between the upper and lower limits, capable of being continuously positioned anywhere along the aperture 109 axis with the cap 120 and the base 124 capable of being biased away from each other in a continuous manner, regardless of whether the cap 120, or the base 124 are anchored. In one embodiment, the terms actuation element and floating element are interchangeable.

Additionally, the cap 120 and/or base 124 may be sized or configured to limit how close the upper portion of the cap 120 can come to the outer lower surface 131 of the base 124. For example, according to the embodiment shown in FIG. 3A, the outer portion 123 of the cap 120 may be sized to allow for an interference with at least a portion of the base 124 at the lips 129 so as to limit the distance the cap 120 may travel when a compression force is applied to the actuator element 104. These limitations in the distance the cap 120 may extend inwardly or outwardly from the base 124 according to certain embodiments of the present invention may provide an additional security against successful, unauthorized duplication of the key assembly 100.

As shown in FIG. 1, the floating element 104 may be positioned along the blade 112 of the key blank 102. According to one embodiment, element 104 may be captured in an aperture 109 defined by an opening in the key blank 102 thereby defining an internal surface having a shelf thereon 111. The shelf 111 may be located anywhere along the axial dimension of the aperture 109 and may be used to capture the cap 120, the base 124 or the channel created by upper portion of the cap 123, the lower protrusion 121 and the inwardly extending base lips 129, of floating element 104. The aperture 109 may be a continuous aperture or may include one or more counter bores.

The precise location of each floating element 104 and the number of floating elements 104 on the blade 112 may vary. Additionally, the blade 112 may include one or more floating elements 104 that may have the caps 120 positioned above or recessed in the first surface 106, or the base 124 below or recessed in the second surface 108, or a combination thereof. According to an embodiment illustrated in FIG. 1, the cap 120 may be positioned along the first surface 106. The base 124 may be positioned at, below or recessed to the second surface 108. According to other embodiments, both the cap 120 and the base 124 are configured to be able to be biased away from each other and/or the adjacent surface of the blade 112.

Accordingly and in one embodiment, provided herein is key assembly 100 having a key blade 112, the key blade 112 having a first surface 106 and a second surface 108, the key blade 112 configured to be inserted into a mating lock 200; an aperture 109 in the key blade 112, the aperture having an axis; a cap 120 having an outer surface 123, captured in the aperture 109 for continuous axial travel between a first limit extending out of the first surface 106 and a second limit recessed within the aperture 109; and a base 124 having an outer surface 131, captured in the aperture 109 for continuous axial travel between a first limit extending out of the second surface 108 and a second limit recessed within the aperture 109; wherein the base 124 is biased away from the cap 120.

Figure 4A:
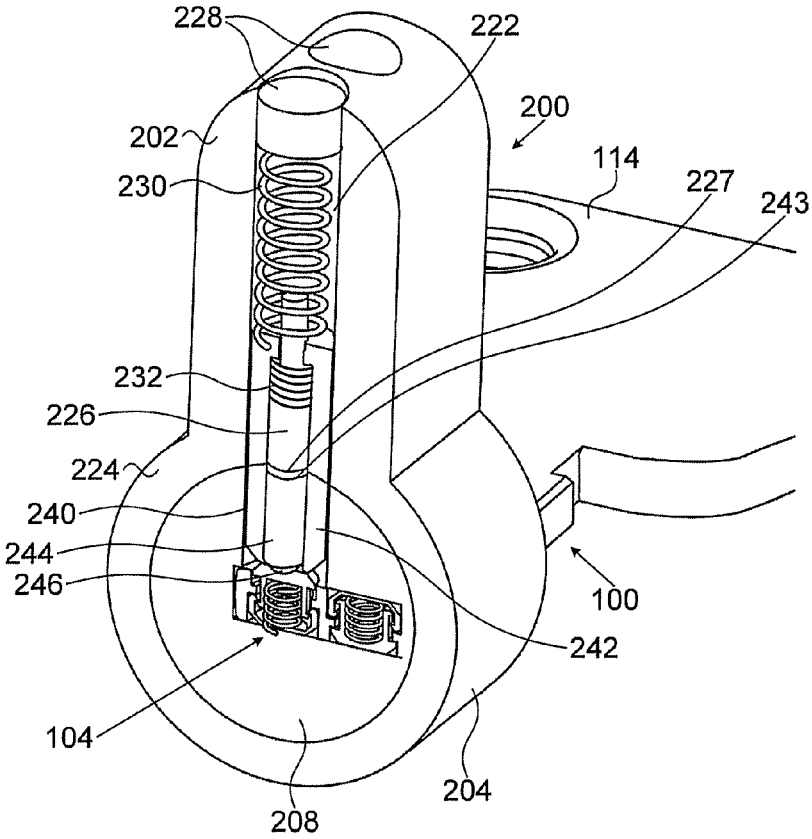
FIG. 4 illustrates a cross sectional perspective view of a key assembly engaging a lock assembly according to an embodiment of the present invention.
Figure 4B:
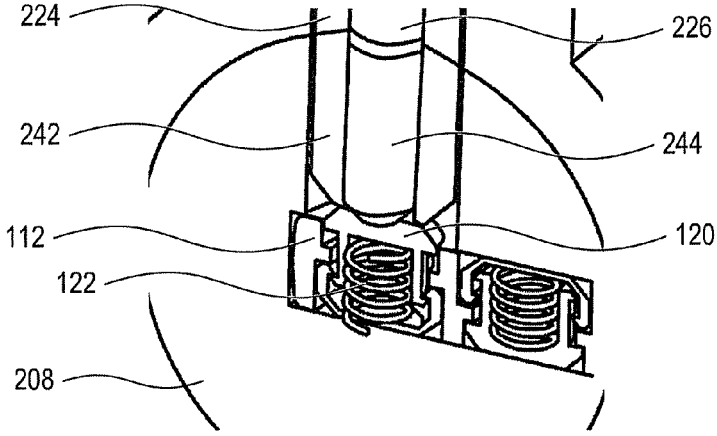

FIG. 4 illustrates a cross sectional perspective view of a key assembly 100 engaging a lock assembly 200 according to an embodiment of the present invention. The column 202 may include at least one bore 222 that is configured for the sliding movement of a first pin housing 224. An outer end of bore 222 may be closed, such as, for example, through the use of a plug 228. An outer actuator 230, such as a spring, may inwardly bias the first pin housing 224, such as, for example, biasing the first pin housing 224 toward the cylinder 208.

A first pin 226 may be positioned for a sliding engagement within the first pin housing 224. According to on embodiment, the first pin 226 may be inwardly biased from the pin housing 224 by an inner pin actuator 232. According to an embodiment, the inner pin actuator 232 may be a spring. However, other actuators 232 may be used to bias the first pin 226, including, for example, a magnet, an electromagnet, air pressure and the like in other embodiments. According to the embodiment illustrated in FIG. 4, a distal end of the first pin 226 may engage the inner pin actuator 232.

As shown in FIG. 4, the cylinder 208 includes at least one cylinder aperture 240 configured for the sliding movement of a second pin housing 242. The second pin housing 242 may be configured to receive and allow the sliding movement of a second pin 244. The second pin 244 includes a second pin upper surface 243 and a second pin lower surface 246. The second pin upper surface 243 may be configured for engagement with the distal end 227 of the first pin 226.

Figure 5A:
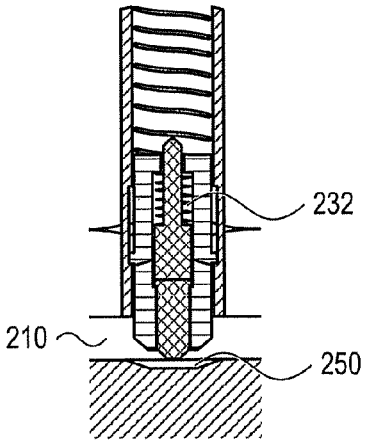
FIG. 5 illustrates a cross sectional view of a lock assembly prior (5*a*) to the insertion of a mating key assembly into a lock assembly containing a depression in the key way.
FIG. 5*b* shows the insertion of the key.
FIG. 5*c* shows the key blade lifting a pin in the lock assembly according to an embodiment of the invention.
Figure 5B:
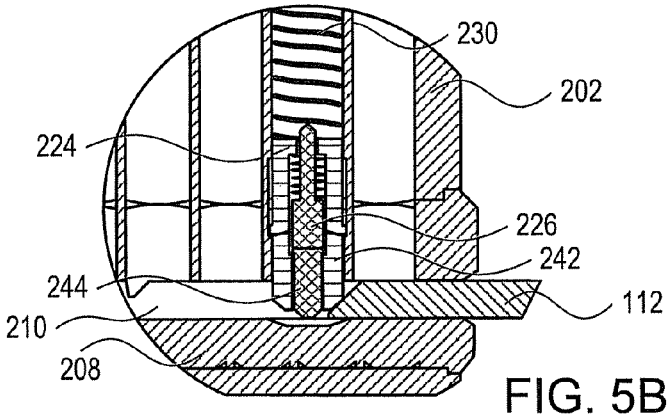
Figure 5C:
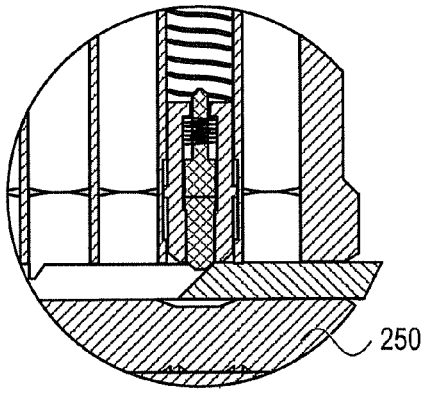

Turning now to FIG. 5 illustrating a cross sectional view of a lock assembly 200 prior to the insertion and positioning of a mating key assembly 100 according to an embodiment of the invention. As shown, (FIG. 5*a*) in one embodiment when a key blade 100 is not inserted into the lock assembly 200, the outer actuator 230 biases the first pin housing 224 and first pin 226 downwardly or inwardly. Alternatively or in addition to the outer actuator 230, the inner actuator 232 may also downwardly or inwardly force or bias the first pin 226. These forces may move the first pin housing 224 and/or first pin 226 in a downwardly direction, so that at least a portion of the first pin housing 224 and/or first pin 226 enter into the cylinder 208 aperture 240 while another portion of the first pin housing 224 and/or first pin 226, respectively, remains in the drum 206, thereby preventing the rotation of cylinder 208. As shown in FIG. 5*a*, in one embodiment of the invention, when a depression 250, is disposed in the guide way 210 of the cylinder 208 of lock assembly 200, cylinder 208 aperture 240 is configured to prevent the lower pin housing 242 from sliding into the depression 250, likewise, pin housing 242 is configured to limit the downward motion of pin 244 into depression 250 in the guide way 210 of cylinder 208 in lock assembly 200. As shown in FIG. 5*b*, pin housing 242 and pin 244 are beveled in their distal end at an angle that is configured to interact with the angle at the distal end of key blade 112, such that sliding key blade 112 into the guide way 210 engages the beveled distal end of pin housing 242 (FIG. 5*b*), lifting the housing 242 from guide way 210 and then likewise proceed to engage pin 244 (FIG. 5*c*) and lift pin 244 from guide way allowing the pin to align with floating element 104 (not shown). Absent the configuration shown in FIG. 5, pin housing 242 and pin 244 would slide into depression 250 and prevent the insertion of key blade 112, thereby, through the use of the right angle in beveling both the key blade 112 and the distal ends of pin housing 242 and pin 244, in combination with a lock assembly 200 having a depression 250 disposed in the guide way 210 of the cylinder 208, the inventors have added to the complexity and thereby the security of the key/lock combination.

The presence of the first pin housing 224 and/or first pin 226 in both the cylinder aperture 240 and the drum 206 of the column 202 creates an interference that prohibits the rotational movement of the cylinder 208 about the barrel 204. For the embodiment illustrated in FIG. 4, when a key assembly 100 is positioned into the lock assembly 200, and the floating element 104 is properly positioned on the blade 112 so that the cap 120 in floating element 104 engages the second pin housing and/or pin 242, 244, then when the biasing means 122, such as a spring in one embodiment exerts the correct amount of force to counter the forces exerted on the actuator (such as forces created by outer actuator 230 and inner pin actuator 232) and to move at least a portion of the floating element 104, such as for example the cap 120, a proper distance, the first pin housing 224 and/or first pin 226 may be forced outside of the cylinder 208 without a portion of the second pin housing 242 and/or second pin 244 entering the bore 222. If these criteria are satisfied, the first pin housing and pin 224, 226 respectively and second pin housing and pin 242, 244 respectively may be positioned so as to not inhibit the rotational movement of the cylinder 208 about the barrel 204. If however the biasing means 122 in floating element 104 does not exert adequate force in one embodiment; and/or in another embodiment, the location of the base 124 along the aperture 109 axis is not anchored precisely as necessary; and/or, in another embodiment, the cap 120 is not biased away from the base 124 to a sufficient distance; or any combination thereof in other certain embodiments, at least a portion of the first pin housing 224 and/or first pin 226 may continue to be extended into the cylinder aperture 240 while the remainder of the first pin housing 224 and/or first pin 226 is in bore 222 of the column 202, thereby creating an interference that inhibits the rotational movement of the cylinder 208. Conversely, if the biasing means such as a spring in one embodiment exerts too large a force and/or in another embodiment, the location of the base 124 along the aperture 109 axis is not anchored precisely as necessary; and/or, in another embodiment, the cap 120 is biased away from the base 124 to an extended distance; or any combination thereof in other certain embodiments, at least a portion of the second pin housing 242 and/or second pin 244 may be pushed into bore 222 of the column 202 while the remainder of the second pin housing 242 and/or second pin 244 remains in the cylinder aperture 240, thereby creating an interference that inhibits the rotational movement of the cylinder 208.

FIG. 5 illustrates the second pin housing 242 and second pin 244 touching the bottom of the lock guide way 210 prior to the insertion of the key assembly 100. According to such an embodiment, the second pin housing 242 and second pin 244 and/or key assembly 100 may be configured to allow the second pin housing 242 and second pin 244 to be lifted outwardly when a key assembly 100 is inserted into the lock assembly 200, such as, for example, through the use of tapered surfaces. Further, the second pin housing 242 and second pin 244 need not be touching the bottom of the lock guide way 210 prior to the corresponding key assembly 100 being inserted into the lock assembly 200. Moreover, the second pin housing 242 and second pin 244 may be in the lock guide way 210 but above the bottom of the lock guide way 210 before the insertion of the key assembly 100 so as to minimize possible interference with the ability to position the key assembly 100 into the lock assembly 200.

Figure 6A:
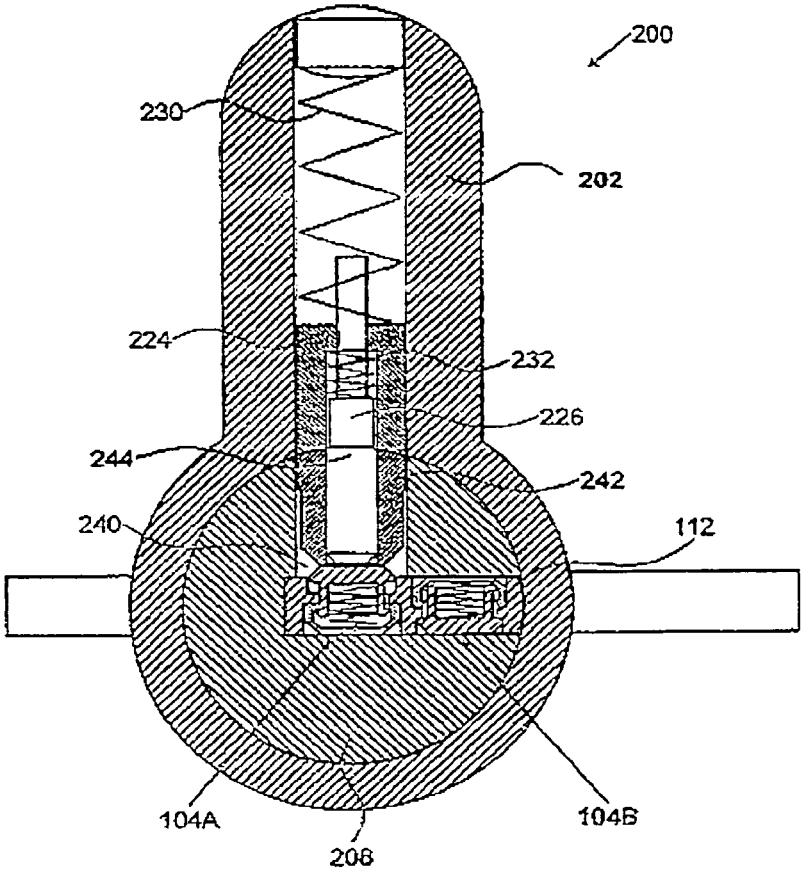
FIG. 6*a* illustrate a cross sectional view of a key assembly having multiple actuation elements positioned in a lock assembly according to an embodiment of the present invention. 6*b* illustrates an enlarge view of an actuation element in FIG. 6*a* engaging a second pin according to an embodiment of the present invention. 6*c* illustrates a partial cross sectional view of key assembly having a contoured cap posited in a lock assembly that includes a second pin having a mating contoured tip according to an embodiment of the present invention.
Figure 6B:
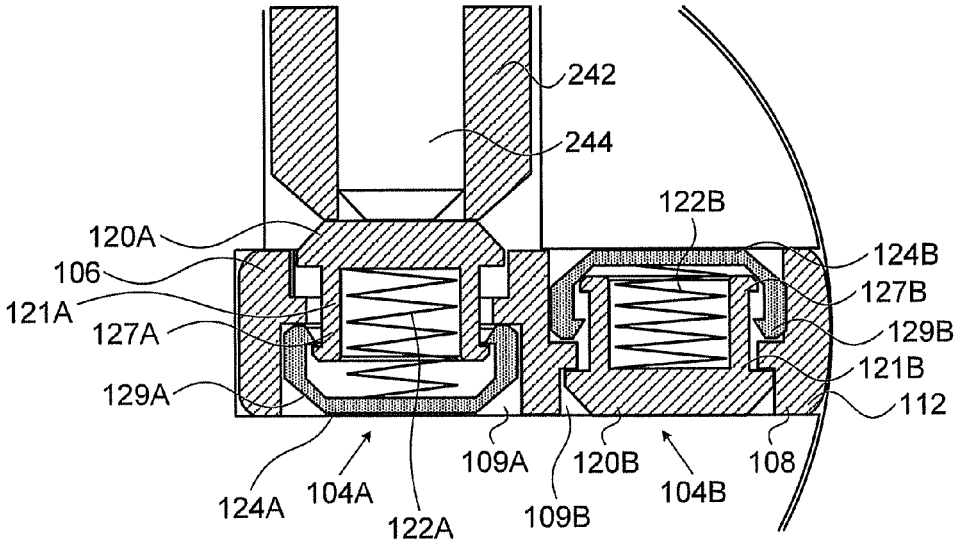

FIG. 6*a* illustrate a cross sectional view of a key assembly 100 having multiple floating elements 104*a*, 104*b* rotatably symmetrical, positioned in a lock assembly 200 according to an embodiment of the present invention. FIG. 6*b* illustrates an enlarge view of floating element 104*a* in FIG. 6*a* engaging a second pin 244 according to an embodiment of the present invention. As shown, floating elements 104*a* and 104*b* may have caps 120*a*, 120*b* respectively positioned along or about the first and second surfaces 106, 108, respectively, of the key blade 112. While floating elements 104*a*, 104*b* are illustrated as being next to each other, in certain other embodiments, floating elements 104*a*, 104*b* may be spaced apart at different locations along the length and/or width of the blade 112. Further, although FIGS. 6*a*, 6*b* illustrate only a mating cylinder aperture 240, pins 226, 244 respectively, pin housings 224, 242 respectively and actuators 230, 232 respectively for one of the floating elements 104*a*, the lock assembly 200 may also include similar components for other floating elements 104*b*.

As illustrated in FIG. 6*b*, floating elements 104*a*, 104*b* may be positioned in apertures 109*a*, 109*b* respectively that have counter bores having a depth that allows the upper surface of the caps 120*a*, 120*b* and bottom surface of the base 124*a*, 124*b* to be flush, above, or recessed in the respective first or second surface 106, 108 of key blade 112.

According to the embodiment illustrated in FIGS. 6*a*, 6*b*, when the key assembly 100 is properly positioned within lock assembly 200, floating element 104*a*, cylinder aperture 240, and bore 222 of the column 202 are aligned. The biasing means, such as a spring in one embodiment 122*a* of the floating element 104*a* may then be actuate. The extent the biasing means 122*a* such as an identical-pole facing magnet in certain embodiment may be actuated depend in one embodiment on several design criteria. For example, the size and force of the biasing means 122*a* may be countered by the size and force of the outer actuator 230 and/or inner pin actuator 232, alone or in combination. Additionally, the tabs 127*a* of the cap 120*a* and lips 129*a* of the base 124*a* may limit the distance the cap 120*a* may be biased away from the base 124*a*. Each of these design criteria may be implemented in precisely controlling the distance or amount the may move the first pin housing 224 and first pin 226 and/or second pin housing 242 and second pin 246 so as to allow for the cylinder 208 to be rotated, and thereby operate the lock assembly 200.

Figure 12:
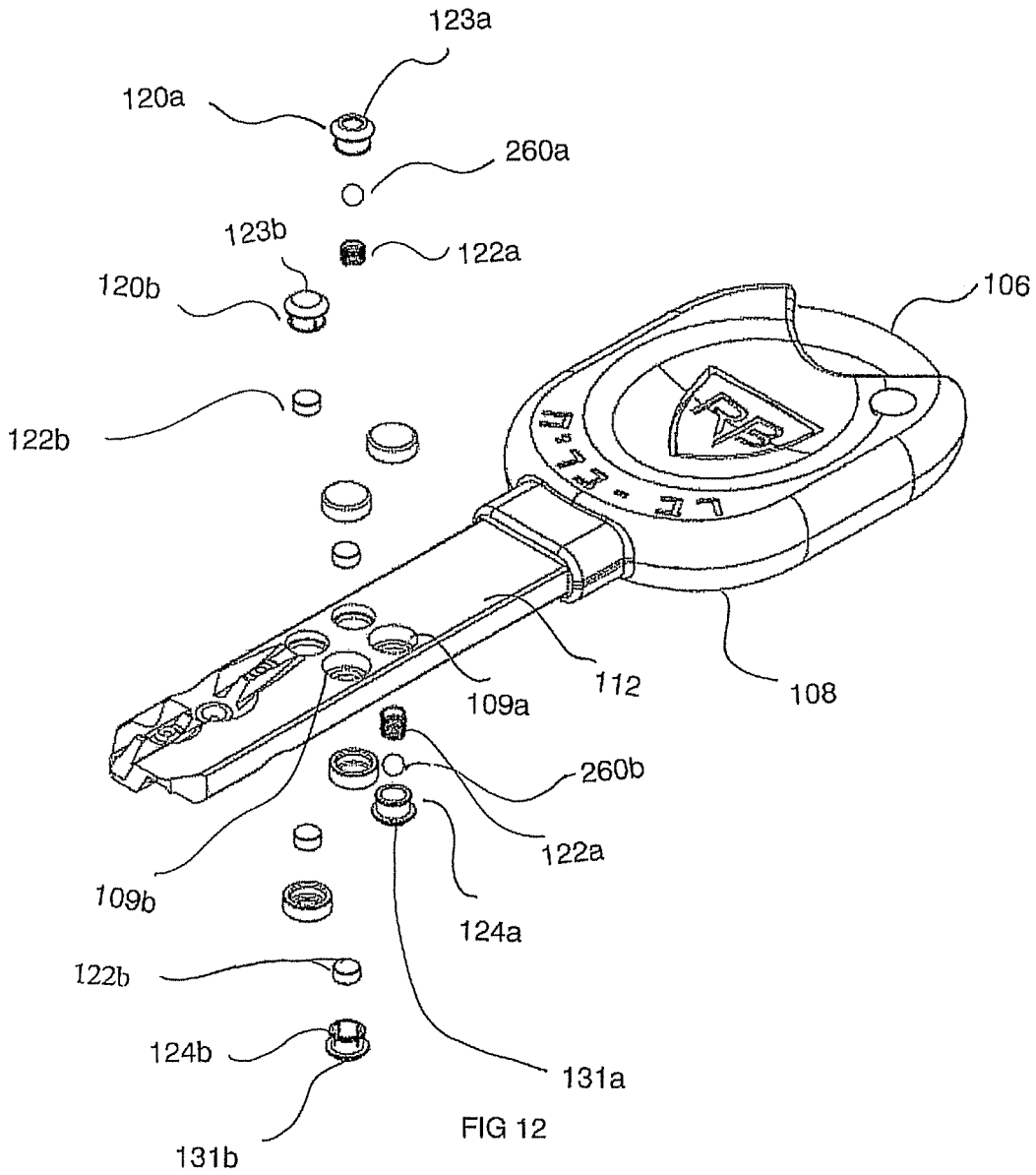
FIG. 12 is an exploded view of an embodiment of the key blade where the biasing elements are magnets and mechanical.

In one embodiment, the key blade may comprise a combination of actuating means such as magnets and springs. FIG. 12, shows an exploded view of such embodiment having four (4) symmetrically positioned floating elements wherein floating element (104*a*) in the key blade (112), where key blade (112) is having a first surface and a second surface (108), the key blade configured to be inserted into a mating lock; a first aperture (109*a*) in the key blade (112), the aperture having an axis; a cap (120*a*) having an outer surface (123*a*, FIG. 3), captured in the aperture (109*a*) for continuous axial travel between a first limit extending out of the first surface (106) and a second limit recessed within the aperture (109*a*); and a base (124*a*) having an outer surface (131*a*), captured in the aperture (109*a*) for continuous axial travel between a first limit extending out of the second surface (108) and a second limit recessed within the aperture (109*a*); wherein the base (124) is biased away from the cap (120) with a biasing means (122*a*) which is a spring with ball bearing (260*a* and 260*b*) disposed on opposite sides of the spring (122*a*) and protruding from both the base (124*a*) and the cap (120*a*); and wherein floating element (104*b*) is embedded in a second aperture (109*b*) in the key blade (112), the second aperture (109*b*) having an axis; a cap (120*b*) having an outer surface (123*b*), captured in the second aperture (109*b*) for continuous axial travel between a first limit extending out of the first surface (106) and a second limit recessed within the aperture (109*a*); and a base (124*b*) having an outer surface (131*b*), captured in the second aperture (109*b*) for continuous axial travel between a first limit extending out of the second surface (108) and a second limit recessed within the second aperture (109*b*); wherein the base (124*b*) having a magnet (122*b*') associated therewith is biased away from the cap (120*b*) having a magnet (122*b*") associated therewith, the magnets (,) positioned with the same poles facing facing adjacent surfaces thus creating a repelling force and biasing the cap (120*b*) from the base (124*b*).

In one embodiment, provided herein is a key assembly (100) comprising: a key blade (112), the key blade being substantially flat and having a first surface (106) and a second surface (108), the key blade configured to be inserted into a mating lock (200); an aperture in the key blade (109), the aperture having an axis; a cap (120) having an outer surface (130), captured in the aperture (109) for continuous axial travel between a first limit extending out of the first surface (106) and a second limit recessed within the aperture (109); and a base (124) having an outer surface (131), captured in the aperture (109) for continuous axial travel between a first limit extending out of the second surface (108) and a second limit recessed within the aperture (109); and a magnet (122) associated with the base (124), the cap (120) or both, the magnet having sufficient magnetic strength to attract or repel a movable part in the key blade (112), or the lock (200) from a locking position to an unlocking position in the lock (200), or in both the key (100) and the lock (200).

For example, in the embodiment illustrated in FIGS. 6*a*, 6*b*, the biasing means, 122*a* such as a spring in one embodiment, may activate to allow cap 120*a* to be biased outwardly against the mating second pin housing 242 and/or second pin 244. Whether the cap 120*a* engages either the second pin housing 242, the second pin 244, or both, may be determined by the size, shape, and/or configuration of the mating surfaces of the cap 120*a*, second pin housing 242, and second pin 244. For example, as shown in FIGS. 6*b*, the relative sizes of the cap 120*a*, second pin housing 242, and second pin 244 allow the cap 120*a* to directly engage both the second pin housing 242 and second pin 244.

Figure 6C:
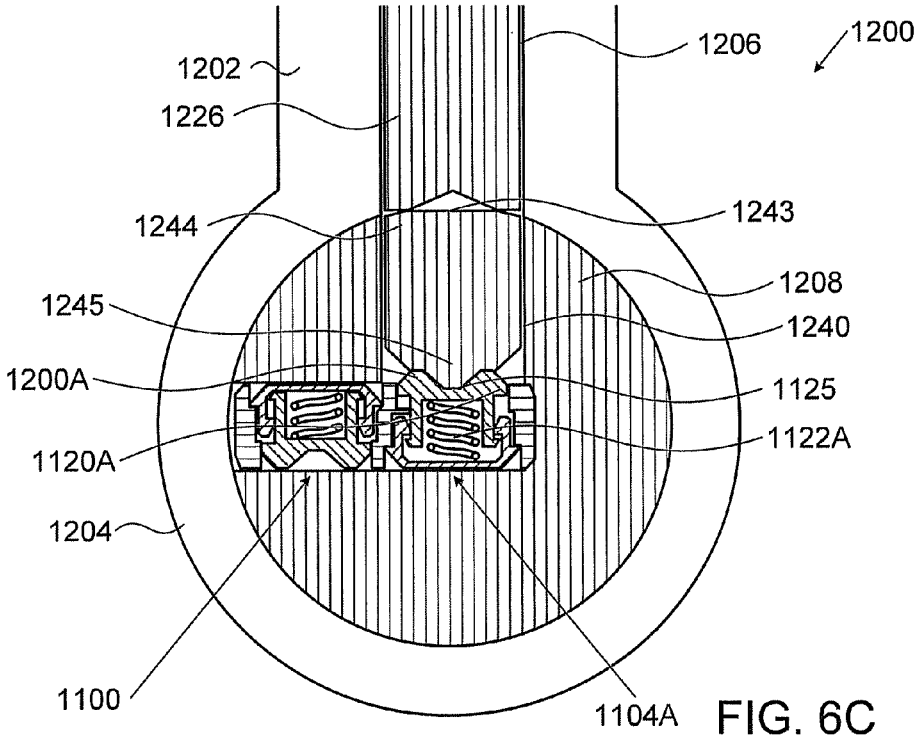

Additional combinations, and thereby security may be provided by requiring that the second pin housing 242 and second pin 244 mate a specific surface configuration of the cover 120*a*. For example, FIG. 6*c* illustrates a partial cross sectional view of key assembly 1100 having a contoured cap 1120*a* posited in a lock assembly 1200 that includes a second pin 1244 having a mating contoured tip 1245 according to an embodiment of the present invention. In the embodiment shown in FIG. 6*c*, the use of first and second pin housings have been eliminated. Therefore, the column 1202 includes a drum 1206 configured for the placement and sliding movement of a first pin 1226, and the cylinder 1208 includes an aperture 1240 configured to receive and allow the sliding movement of a second pin 1244. As illustrated, the second pin 1244 includes a tip 1245 that is configured to mate with the contoured surface of the cap 1120*a* so that, when engaged, a portion of the tip 1245 fits within a recess 1125 in the cap 1120*a*. If the portion of the tip 1245 were too large to properly fit all the way within the recess 1125 and thus not mate the recess 1125, the second pin 1244 would sit too high on floating element 1104*a* when the cap 1120*a* is biased away from the base 1124*a*, resulting in at least the upper surface 1243 of the second pin 1244 extending into the aperture 1222 of the column 1202, thereby creating an interference that prohibits the rotational movement of the cylinder 1208 about the barrel 1204. Conversely, if the size of the recess 1125 is too large and/or too deep, the second pin 1244 may sit too deep in the recess 1125, resulting in the second pin 1244 being drawn to far into the floating element 1104*a* when the cap 1120*a* is biased away from the base 1124*a*, resulting in a portion of the first pin 1226 being moved inwardly so that the first pin 1226 is in both in the drum 1206 of the cylinder 1208 and the aperture 1222 of the column 1202. The presence of the first pin 1226 in both the bore 1222 of the column 1202 and the aperture 1240 of the cylinder 1208 creates an interference that inhibits the rotational movement of the cylinder 1208, and thereby prohibits unlocking of the lock. Therefore, even a slight error in sizing in an unauthorized attempt to replicate and use the key assembly of the present invention unsuccessful.

Referencing FIGS. 6*a*, 6*b*, the second pin housing 242 and/or second pin 244 may then be moved against the force of the outer actuator 230 and/or inner pin actuator 232 to move the first pin housing 224 and first pin 226 into the bore 222 of the column 202 while the second pin housing 242 and/or second pin 244 remain in the cylinder aperture 240. More specifically, the engagement between the first pin housing and pin 224, 226 with the second pin housing and pin 242, 244 occurs at a distance equal to the diameter of the cylinder 208 so that the cylinder 208 can be rotated without prohibitive interference from the first pin housing and pin 224, 226 and the second pin housing and pin 242, 244. This requires precise forces from the biasing means 122 such as a spring in one embodiment, and actuators 230, 232 and tight tolerances for at least the fixed location of the floating element 104 along the aperture 109 axis, pins 226, 244, and pin housings 224, 242. Once the key assembly 100 is allowed to rotate in the cylinder 208, the key assembly 100 may operate as a traditional key to unlock the lock assembly.

Different types of actuators for biasing means 122, outside actuator 230, and/or inner pin actuator 232 may be used. More specifically, although the biasing means 122, and actuators 230, and 232 are illustrated in FIG. 6*a* as springs, other types of actuators may be used, for example, a magnet or air pressure, among others. Moreover, biasing means 122, and actuators 230, and 232 may each individually provide a force alone or in conjunction with another biasing means. For example, in embodiments in which the biasing means 122 is an identical pole-facing magnet, a mating magnet in the locking assembly 200 may have a polarity that is identical that of the outer surface of biasing means 122 in the key assembly 100, and thereby be rejected by the actuator 122 when the corresponding key assembly 100 is properly positioned in the lock assembly 200.

Further, rather than provide separate magnets, components of the floating element 104, such as the cap 120, among others, and components of the lock assembly, such as, for example, the second pin 242, among others, may be construction from the necessary metallic materials or be imparted with a specific polarity for floating of the lock assembly 200.

Figure 13:
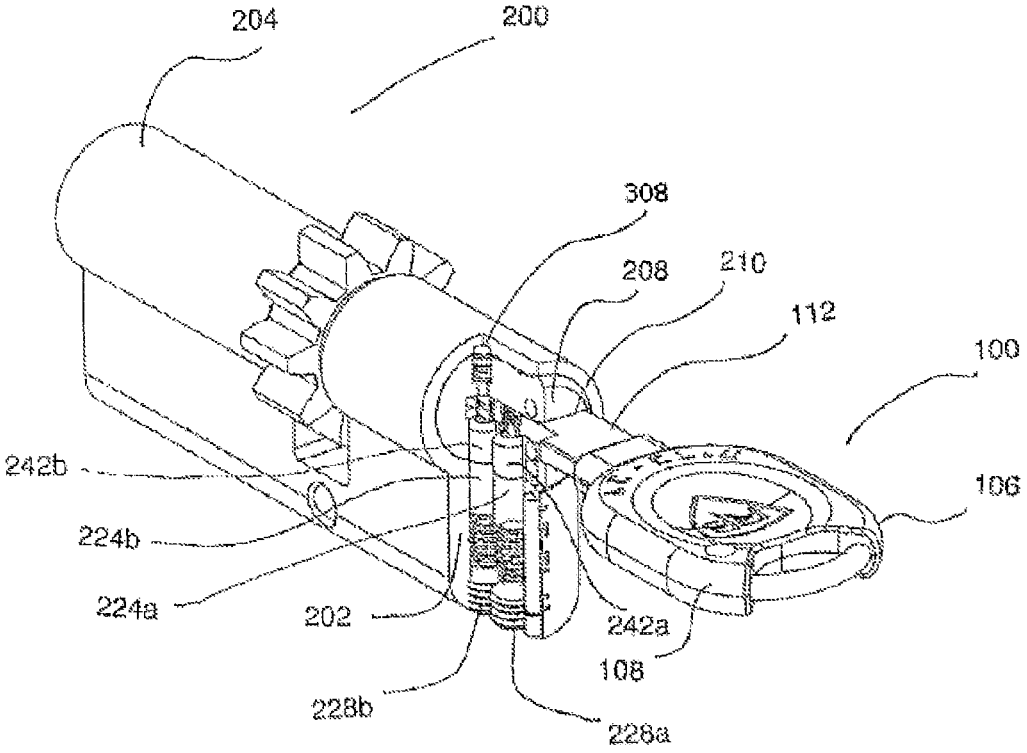
FIG. 13 is an illustration of an embodiment of the key and lock combination having both magnetic and mechanical biasing and locking elements and pins including a magnetic locking safety pin coaxial and diametrically opposed to a magnetic locking pin slidably movable in the lock's column.

Reference is made to FIGS. 12 and 13, providing (FIG. 12) a key assembly 100 positioned in a lock assembly 200 (FIG. 13), the key assembly 100, comprising wherein floating element (104*a*) in the key blade (112), where key blade (112) is having a first aperture (109*a*) in the key blade (112), the aperture having an axis; a cap (120*a*) having an outer surface (123*a*, FIG. 3), captured in the aperture (109*a*) for continuous axial travel between a first limit extending out of the first surface (106) and a second limit recessed within the aperture (109*a*); and a base (124*a*) having an outer surface (131*a*), captured in the aperture (109*a*) for continuous axial travel between a first limit extending out of the second surface (108) and a second limit recessed within the aperture (109*a*); wherein the base (124) is biased away from the cap (120) with a biasing means (122*a*) which is a spring with a ball bearing (260*a*) protruding from both the cap (120*a*); and wherein floating element (104*b*) is embedded in a second aperture (109*b*) in the key blade (112), the second aperture (109*b*) having an axis; a cap (120*b*) having an outer surface (123*b*), captured in the second aperture (109*b*) for continuous axial travel between a first limit extending out of the first surface (106) and a second limit recessed within the aperture (109*a*); and a base (124*b*) having an outer surface (131*b*), captured in the second aperture (109*b*) for continuous axial travel between a first limit extending out of the second surface (108) and a second limit recessed within the second aperture (109*b*); wherein the base (124*b*) having a magnet (122*b*') associated therewith is biased away from the cap (120*b*) having a magnet (122*b*") associated therewith, the magnets (122*b*',122*b*") are positioned with identical poles facing adjacent surfaces thus creating a repelling force and biasing the cap (120*b*) from the base (124*b*). As shown in FIG. 13, lock assembly 200 having a barrel 204, a column 202 extending from the barrel 204, and a cylinder 208 configured to rotate within the barrel 204, the cylinder 208 including a guide way 210; the column 202 having an bore 222 configured to receive the sliding movement of a first pin housing 224*a*, the first pin housing 224*a* configured to receive the sliding movement of a first pin 226*a* (not shown); the cylinder 208 including a cylinder aperture 206*a* (not shown) configured to receive the sliding movement of a second pin housing 242*a*, the second pin housing 242*a* configured to receive the sliding movement of a second pin 244*a* (not shown, the first pin 226*a* being inwardly biased against the second pin 244*a* so as to place the first pin 226*a* in the cylinder aperture 206 when the key assembly 100 is not positioned in the lock assembly 200; the key assembly 100 configured to outwardly bias and move the cap 120*b* or the base 124*b* against the first pin 226*a* using the magnetic biasing force of floating element 104*b* when the key assembly 100 is positioned in the lock assembly 200 so that the second pin 244*a* and the second pin housing 242*a* are located inside the cylinder 208 and the first pin 226*a* and first pin housing 224 are located outside of the cylinder 208. In certain embodiment the second pin and pin housing are magnetic and the biasing of the second pin is done by the magnetic elements in the key blade such that absent the magnetic force generated by the magnets in the floating element, the lock remains in a locking position.

In another embodiment, provided herein is a lock assembly 200 comprising: a barrel 204; a column 202 extending from the barrel, the column having at least two column apertures 222*a*, 222*b*; a cylinder 208 configured to rotate within the barrel, the cylinder including a guide way 210 sized and configured to receive a key blade 112, the cylinder 208 including a cylinder aperture axially registered with the column aperture 222*a* when the lock assembly is locked, and movable out of registration with the column aperture with the key blade to unlock the lock assembly; a first and a second pin captured by one of the cylinder and the column, the pins having a first portion slidable in the cylinder aperture and a second portion slidable in the column aperture, the pins normally being biased to a locking position with the first portion within the cylinder aperture and the second portion within the column aperture to lock the cylinder relative to the barrel; a magnetically influenced part associated with the first pin, the magnetically influenced part being movable responsive to a magnetic field provided in the guide way to move the first pin to an unlocking position entirely outside one of the cylinder aperture and the column aperture; and a mechanically influenced part associated with the second pin, the mechanically influenced part being movable responsive to a non-magnetic force provided in the guide way to move the second pin to an unlocking position entirely outside one of the cylinder aperture and the column aperture.

Figure 14:
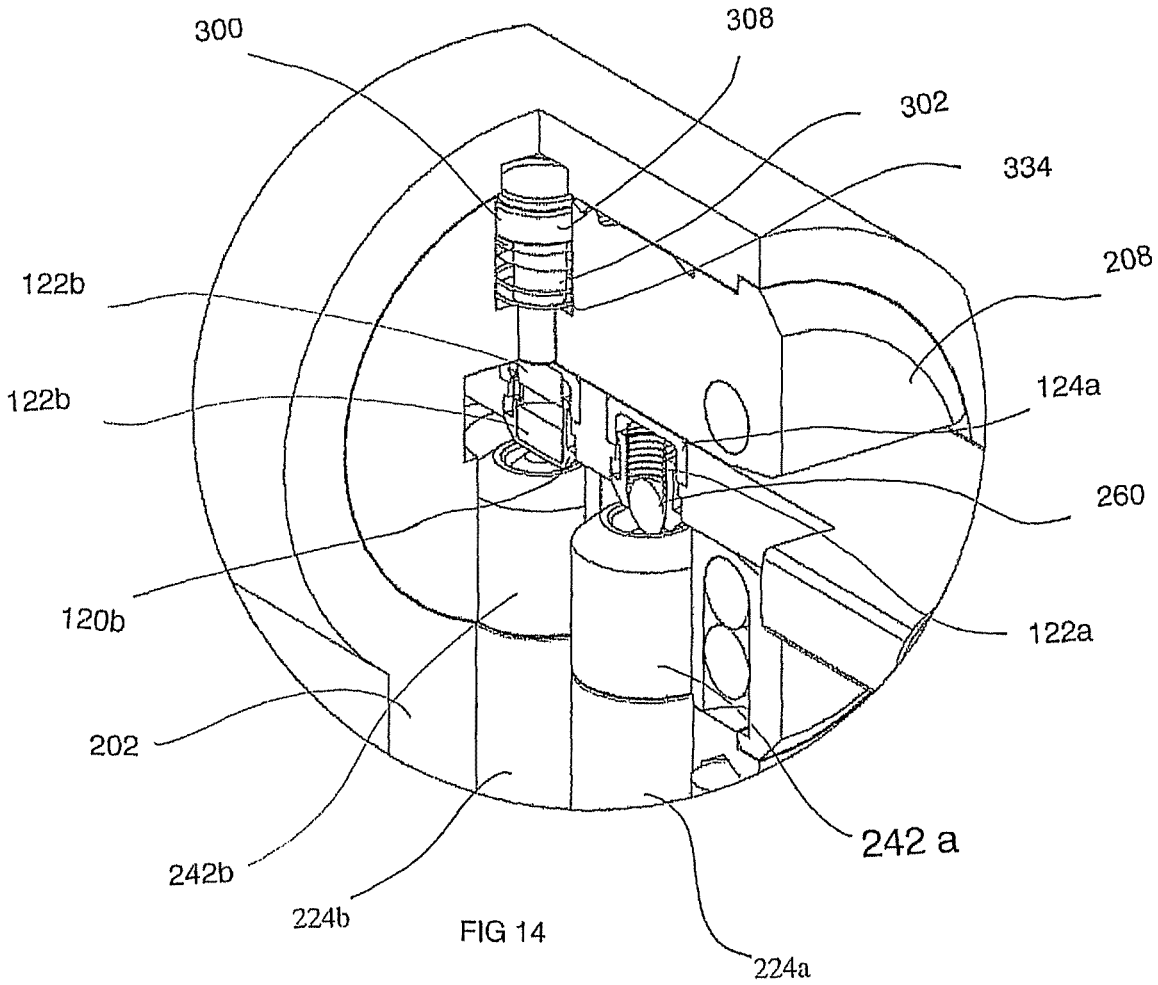
FIG. 14 is a magnified view of an embodiment of the key and lock combination in FIG. 13, illustrating the magnetic biasing elements in the embedded floating elements of the key blade, forcing the locking pin of the column and the locking safety pin of the barrel to their respective positions.

In one embodiment, locking safety pin is non-aligned with any locking pin in column 202. Accordingly and in another embodiment, when key blade 112, comprises floating elements 104*a*, 104 *b*, 104*n* in key blade 112, one floating element having a magnet biasing means (see FIGS. 13, 14) will bias the cap 120 or the base 124 against the locking pin slidably movable in the column 202 aperture 222, while its symmetric counterpart will repel or attract the safety locking pin thus allowing movement of the cylinder 208 in the barrel 206. As shown in FIG. 14, column 202 comprises an additional aperture containing a mechanically biased locking pin, a mechanically biased safety locking pin located within the cylinder and extending within an aperture located in the barrel 208 and an additional magnetic or non-magnetic locking pin.

In one embodiment the magnetically influenced part of either the locking pin or the locking safety pin is integral with the pin and is positioned to repel or attract a magnetic field provided in the keyway. In one embodiment, the magnetically influenced part is associated with the safety locking pin and is slidable within the cylinder aperture adjacent to the keyway and is non-aligned with the locking key. In another embodiment the first locking pin is normally biased into its locking position by a resilient element. In one embodiment, the second column aperture 222*b* is generally coaxial with the first column aperture and diametrically opposed to the first column aperture. In another embodiment, the magnet is movable normal to the direction of insertion of the key blade in the guide way.

In one embodiment, the magnet 122 is further defined as a first magnet 122', the invention further comprising a second magnet 122" associated with the base or the cap, the second magnet being positioned to repel the first magnet normal to the direction of insertion of the key blade in the guide way.

In another embodiment, the biasing means used to move the locking pins is a magnet that is further defined as a first magnet 122*b*', the invention further comprising a second magnet 122*b*" associated with the base or the cap, wherein the first and second magnets being movable with respect to the other magnet, the second magnet being positioned to be repelled by or repel the first magnet normal to the direction of insertion of the key blade in the guide way. In another embodiment the repelling magnets bear between the key blade and the pin to bias the pin into its unlocking position.

For embodiments in which air pressure is used as an actuator, the floating element 104 may include at least one air passageway that is sized to deliver a predetermined amount of pressure to counter the pressure needed to be overcome by the floating element 104 to properly position the first and second pin housings 224, 242 and first and second pins 226, 244 along the interface of cylinder 208 and barrel 204 so as to allow the cylinder 208 to rotate.

According embodiments of the present invention, when in the locked position prior to the insertion of a key assembly 100, rather than creating an inference by moving a portion of the first pin housing 224 and/or first pin 226 into the cylinder aperture 240, a portion of the second pin housing 242 and/or second pin 244 may instead be drawn into the bore 222 of the column 202 while another portion of the second pin housing 242 and/or second pin 244, respectively, remains in the cylinder aperture 240. According to such an embodiment, the floating element 104 may have a polarity opposite to a polarity in the lock assembly 200 that may draw the second pin housing 242 and/or second pin 244 out of the aperture 240 while retaining the first pin housing 224 and first pin 226 in the bore 222 of the column 202 so that the first and second pins and housings, 224, 226, 242, 244 respectively do not inhibit the rotational movement of the cylinder 208 about the barrel 204. According to one such embodiment, biasing means 122 and the first pin 224, second pin 242, first pin housing 226, and/or second pin housing 244 may be construction of magnets or be imparted with polarities that, when properly mated, allow the first pin 226, second pin 244, first pin housing 224, and second pin housing 242 be positioned in the lock assembly 200 so as to not inhibit the rotational movement of the cylinder 208.

In one embodiment, the invention provides a key assembly 100 positioned in a lock assembly 200, the key assembly 100, comprising: a key blade 112, the key blade having a first surface 106 and a second surface 108, the key blade 112 configured to be inserted into the lock 200; an aperture 109 in the key blade 112, the aperture 109 having an axis; a cap 120 having an outer surface 123, captured in the aperture 109 for continuous axial travel between a first limit extending out of the first surface 106 and a second limit recessed within the aperture 109; and a base 124 having an outer surface 131 captured in the aperture 109 for continuous axial travel between a first limit extending out of the second surface 108 and a second limit recessed within the aperture 109; wherein the base 124 is biased away from the cap 120; the lock assembly 200 having a barrel 204, a column 202 extending from the barrel 204, and a cylinder 208 configured to rotate within the barrel 204, the cylinder 208 including a guide way 210; the column 202 having an bore 222 configured to receive the sliding movement of a first pin housing 224, the first pin housing 224 configured to receive the sliding movement of a first pin 226; the cylinder 208 including a cylinder aperture 206 configured to receive the sliding movement of a second pin housing 242, the second pin housing 242 configured to receive the sliding movement of a second pin 244, the first pin 226 being inwardly biased against the second pin 244 so as to place the first pin 226 in the cylinder aperture 206 when the key assembly 100 is not positioned in the lock assembly 200; the key assembly 100 configured to outwardly bias and move the cap 120 or the base 124 against the first pin 226 when the key assembly 100 is positioned in the lock assembly 200 so that the second pin 244 and the second pin housing 242 are located inside the cylinder 208 and the first pin 226 and first pin housing 224 are located outside of the cylinder 208.

Figure 7:
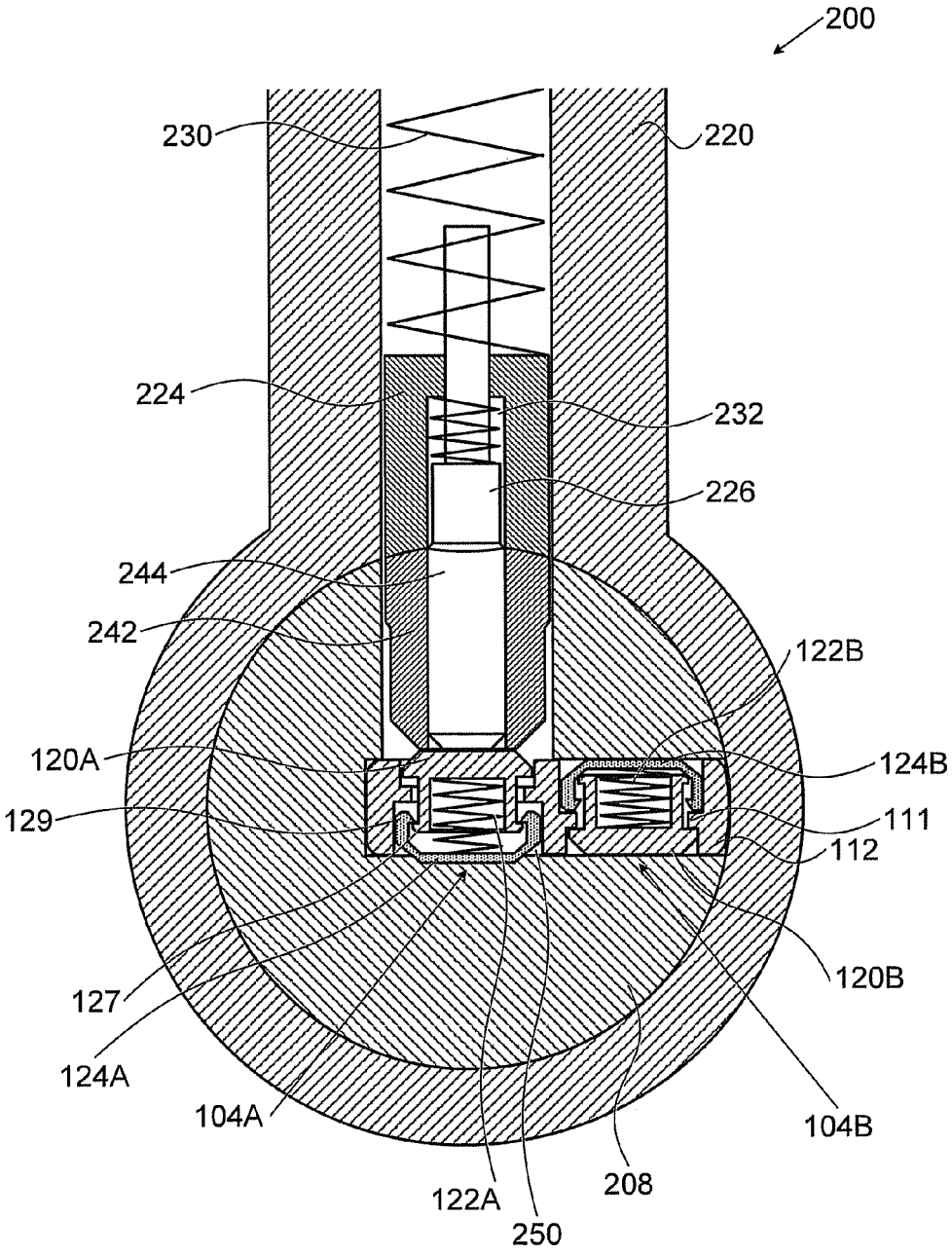
FIG. 7 illustrates a cross sectional view of a section of the lock assembly in which the key assembly has been inserted into the lock assembly according to an embodiment of the present invention.

FIG. 7 illustrates a cross sectional view of a section of the lock assembly 200 in which the key assembly 100 has been inserted into the lock assembly 200 according to an embodiment of the present invention. In this embodiment, the lock guide way 210 includes a depression 250 in which the base 124*a* is inserted when the key assembly 100 is positioned in the lock assembly 200. The addition of the depression 250 and the limit the cap 120*a* may be separated from the base 124*a* by the tabs 127 and lip 129 may reduce the distance that the floating element 104 moves the first and second pins 226, 244 and first and second housings 226, 244. For example, when activated, the base 124*a* may be located in the depression 250, and therefore be lower in the cylinder 208 than where the base 124*a* is located in the embodiment illustrated in FIG. 6. Thus, by lowering the base 124, the cap 120*a* may not extend from surface 106 the key blade 112 in the embodiment in FIG. 7 than the embodiment shown in FIG. 6*a*. A longer second pin 244 and/or second pin housing 242 may therefore be required in the embodiment shown in FIG. 7 so that the engagement of the second housing and pin 242, 244 and first housing and pin 224, 226 occurs along the diameter of the cylinder 208 so as to allow for the cylinder 208 to be rotated, and thereby operate the lock assembly 200.

Figure 8:
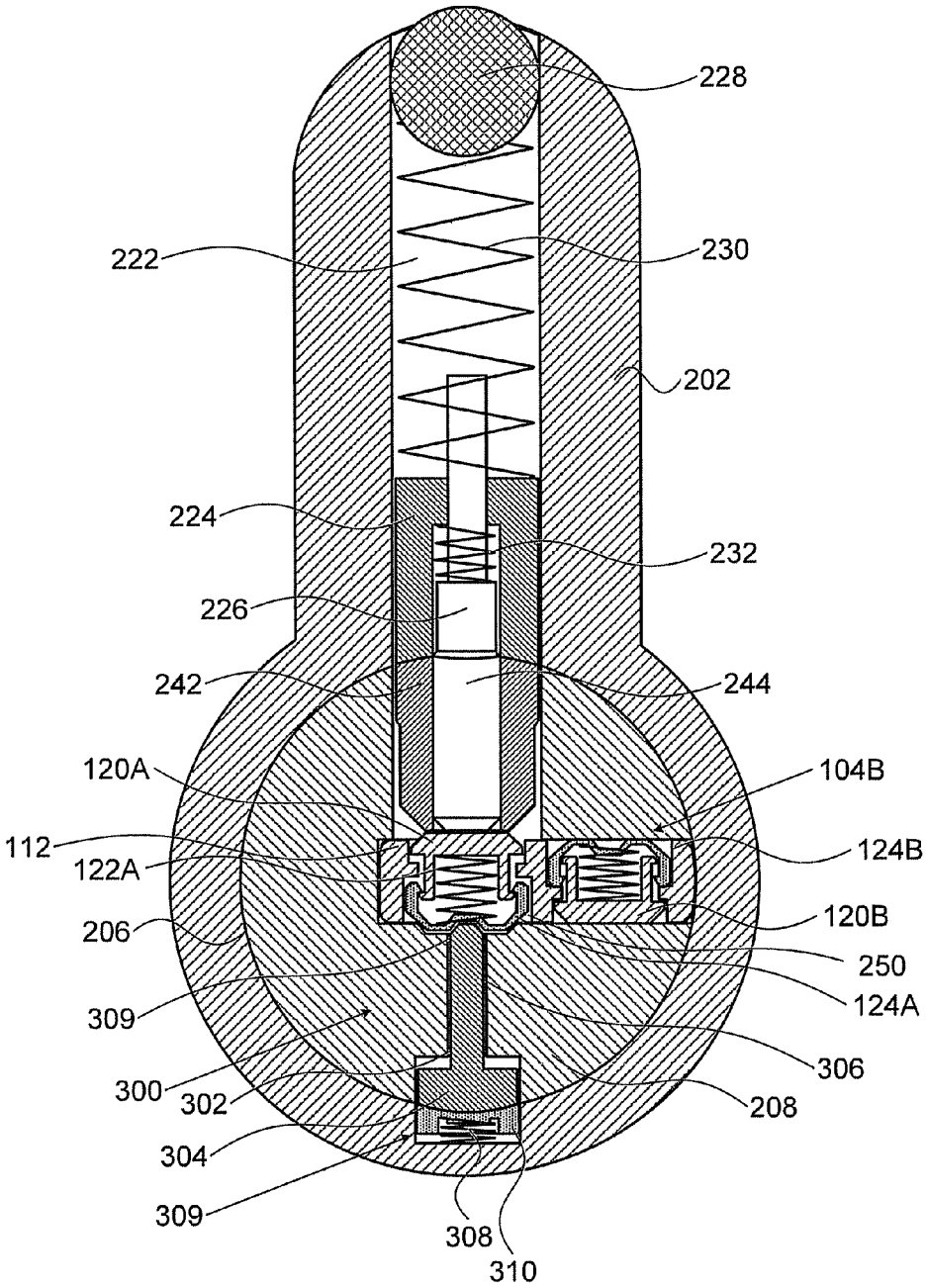
FIG. 8 illustrates a cross sectional view of a section of the lock assembly having a lower pin assembly in which the key assembly has been inserted into the lock assembly according to an embodiment of the present invention.

FIG. 8 illustrates a cross sectional view of a section of the lock assembly 200 having a lower pin assembly 300 in which the key assembly 100 has been inserted into the lock assembly 200 according to an embodiment of the present invention. The lower pin 302 moves through an opening 306 in the cylinder 208 and is under the force of a spring 308. The lower pin assembly 300 includes a lower pin 302 and bottom cylinder 304. As show in FIG. 8, the base 124*a* may have a contoured surface complementary to the tip 309 of the lower pin 302.

Moreover, these mating surfaces of the tip 309 and base 124*a* allow the lower pin 302 to be properly position so that when activated, the lower pin assembly 300 does not extend beyond the outer diameter of the cylinder 208. However, if the tip 309 is improperly configured for the contour of the base 124, the tip may not properly mate the contour of the base 124, but instead may abut against the bottom of the base 124. Such an arrangement may prohibit the lock from operating, as the lower pin assembly 300 may extend beyond the diameter of the cylinder 208, and thereby interfere with the rotation of the cylinder 208.

When the tip 309 does properly mate with the contour of the base 124*a*, the lower pin assembly 300 may extend into the barrel 204 or the plug 310 of the lower actuating element 309 may be forced by a spring 308 into the cylinder 208, both of which may inhibit rotational movement of the cylinder 208.

Figure 9A:
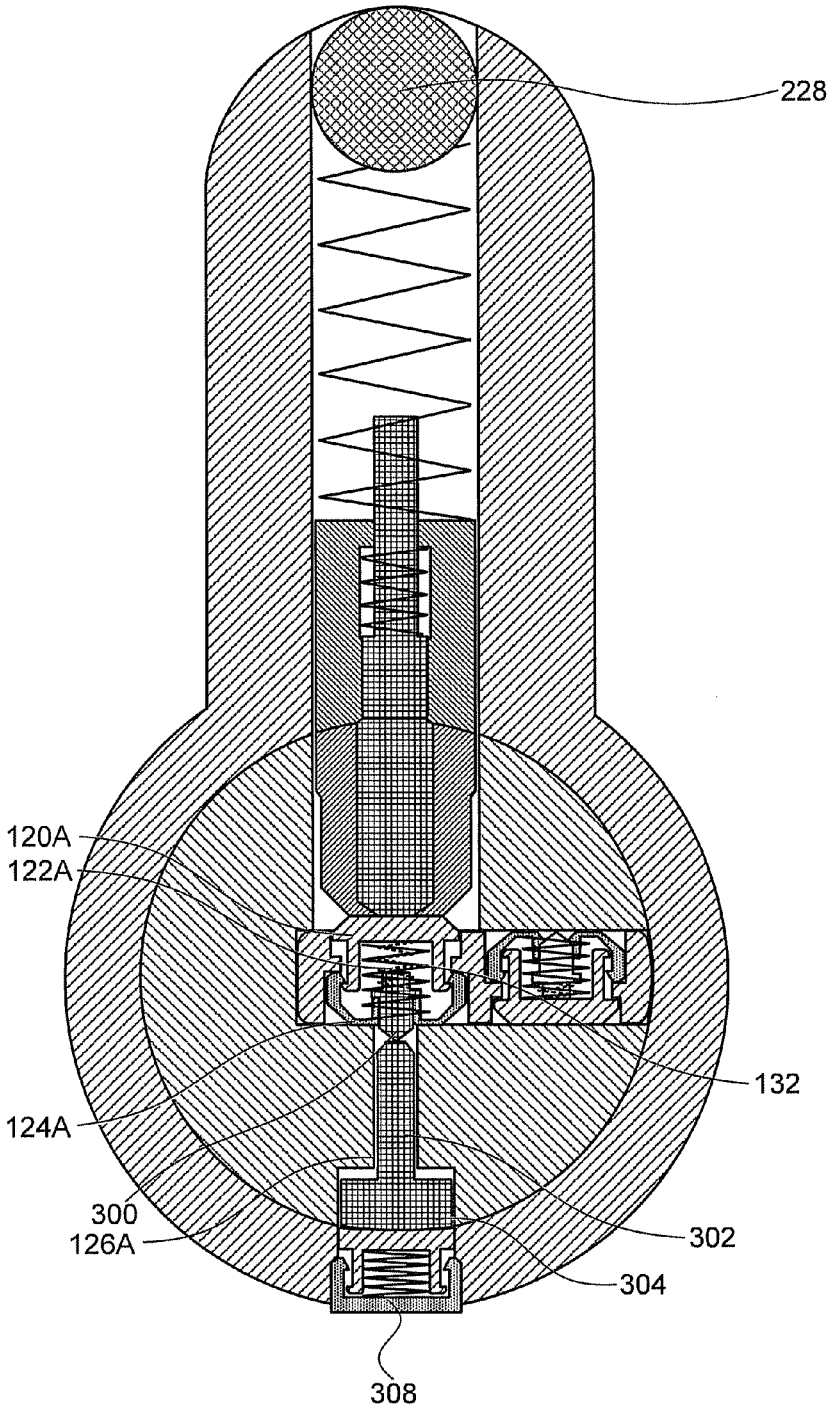
FIG. 9*a* illustrates a cross sectional view of a section of the lock assembly having a lower pin assembly in which the key assembly has been inserted into the lock assembly according to an embodiment of the present invention. 9*b* illustrates a cross sectional view of a section of the key assembly having an actuator pin extending from the cap of the actuation element according to an embodiment of the present invention.

FIG. 9*a* illustrates a cross sectional view of a section of the lock assembly 200 having a lower pin assembly 300 in which the key assembly 100 has been inserted into the lock assembly according to an embodiment of the present invention. In the embodiment illustrated in FIG. 9*a*, the base 124*a* includes an actuator pin 126*a*, a portion of which may slide outwardly through an aperture in the outer surface 131 of base 124*a* beyond the base 124*a*. For example, the base 124*a* may include an orifice through which at least a portion of the actuator pin 126*a* may travel. The actuator pin 126*a* includes a distal end 128, a proximal end 130, and at least one shoulder 132. The distal end 128 engages the tip 309 of the lower pin 302. According to one embodiment, the biasing means 122*a*, such as a spring in one embodiment imparts a downward force against the shoulder 128 to direct the actuator pin 126*a* downwardly against the lower pin 302. Further, the shoulder 128 may limit the distance the actuator pin 126*a* may travel out of the base 124*a* and/or retain the actuator pin 126*a* in the base 124*a* thereby again, increasing the number of possible key/lock combination and adding to the security of the entry way. Due to the precision required in the depth that the bottom cylinder 304 and plug 310 must move to reach the proper position so as to not prohibit the cylinder 208 from moving, the configuration of the actuator pin 126*a* may add further complexity to the ability to the unauthorized successful duplication of the key assembly 100.

Figure 9B:
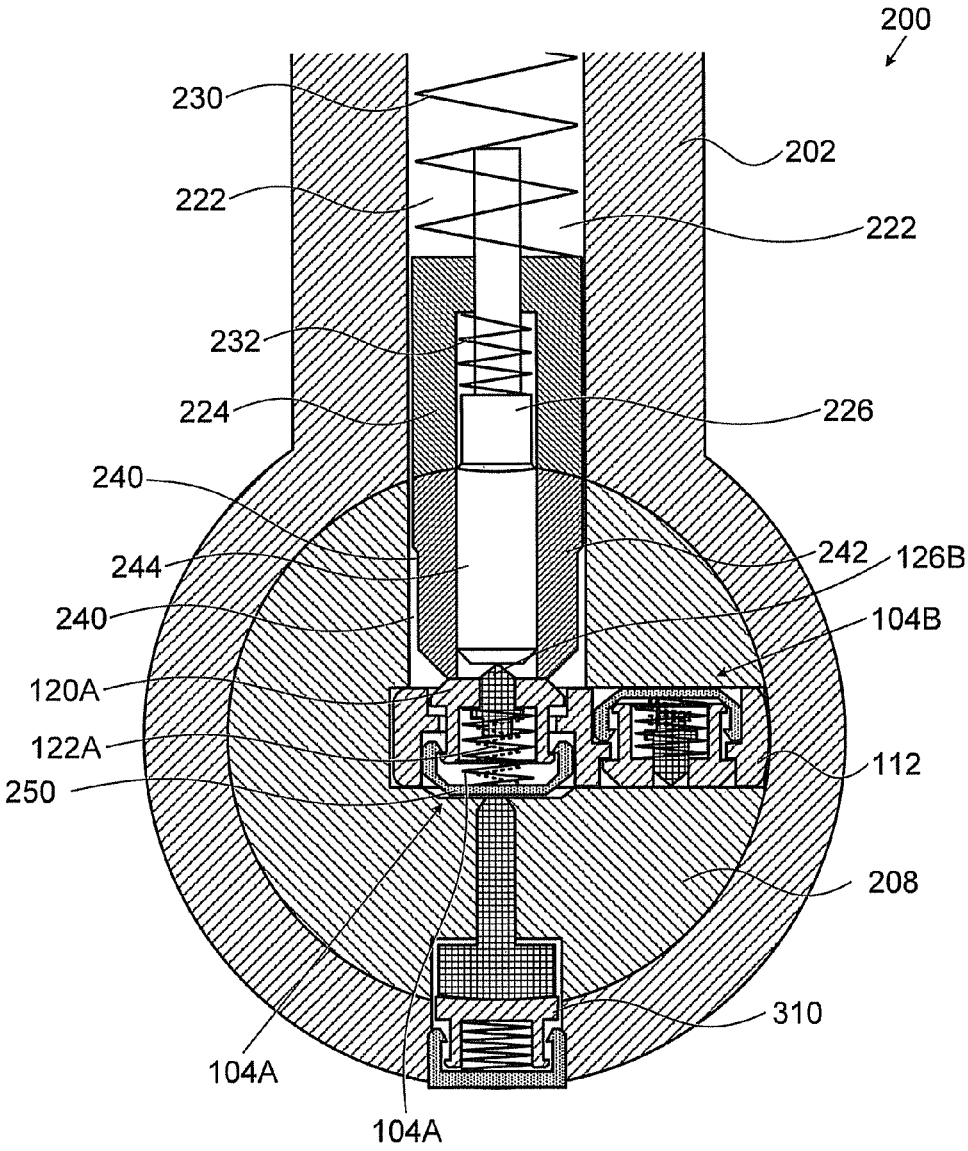

FIG. 9*b* illustrates a cross sectional view of a section of the key assembly 100 having an actuator pin 126*b* extending from the cap 120*a* of the floating element 104*a* according to an embodiment of the present invention. The actuator pin 126*b* shown in FIG. 9*b* is similar to the actuator pin 126*a* shown in FIG. 9*a*, except, rather than extending from the base 124*a* and exerting a force against the lower pin assembly 300, the actuator pin 126*b* in FIG. 9*b* extends from the cap 120 and exerts a force against the second pin 244. Additionally, the embodiment illustrated in FIG. 9*b* includes the feature of a depression 250, as previously discussed with reference to FIG. 7.

Figure 10:
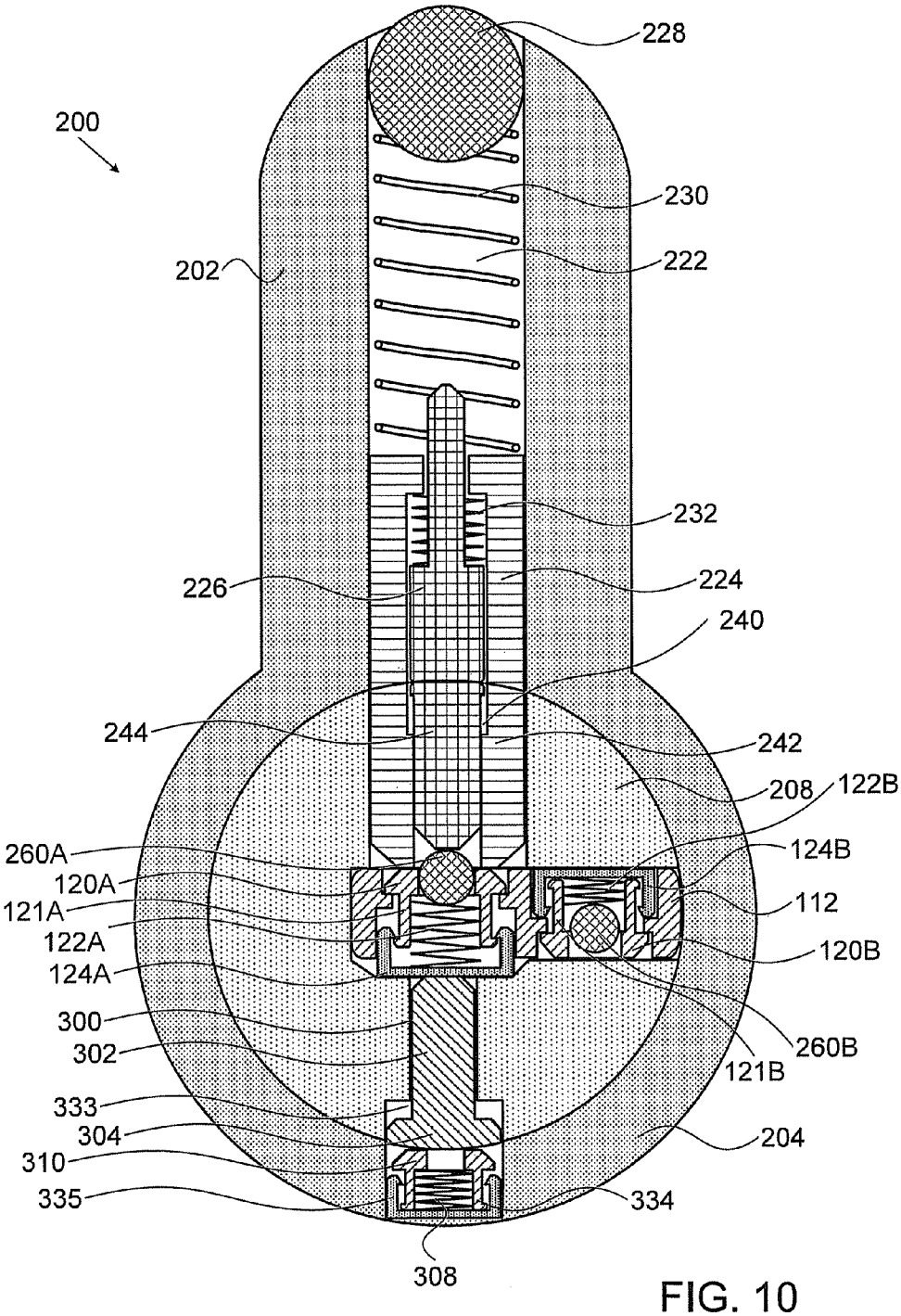
FIG. 10 illustrates a cross sectional view of a key assembly and a lock assembly in which the actuation elements include a protruding ball according to an embodiment of the present invention.

FIG. 10 illustrates a cross sectional view of a key assembly 100 and a lock assembly 200 in which the floating elements 104*a*, 104*b* include a protruding ball 260*a*, 260*b* according to an embodiment of the present invention. The partially protruding ball 260*a*, 260*b* may be retained in the floating elements 104*a*, 104*b* by a variety of different ways, including, for example, having in the cover 120*a*, 120*b* an opening smaller than the outer diameter of the partially protruding ball 260*a*, 260*b*. Biasing means 122*a*, 122*b* such as elastic materials in certain embodiments may force at least a portion of the protruding ball 260*a*, 260*b* to extend outwardly from the cap 120, the base 124 as shown in FIG. 3*b* and FIG. 14, or both in floating elements 104*a*, 104*b*. For example, in the embodiment illustrated in FIG. 10, the biasing mean 122*a* may force at portion of the protruding ball 260*a* to extend beyond the cover 120*a* so that the partially protruding ball 260*a* engages and moves the second pin 244 outwardly while the cover 120*a* engages and moves the second housing 242 outwardly. The distance the protruding ball 260*a* extends from the cover 120*a* is configured so that the second pin 244 moves the distance required to move the first pin 226 out of the aperture 240 of the cylinder 208 and into the bore 222 of the column 202 while retaining the second pin 244 in the aperture 240 of the cylinder 208. Additionally, because the partially protruding ball 260*a* extends from the cover 120*a*, the second pin 244 may have a different length than that of the second pin housing 242, further complicating the unauthorized duplication of the key assembly 100.

Figure 11:
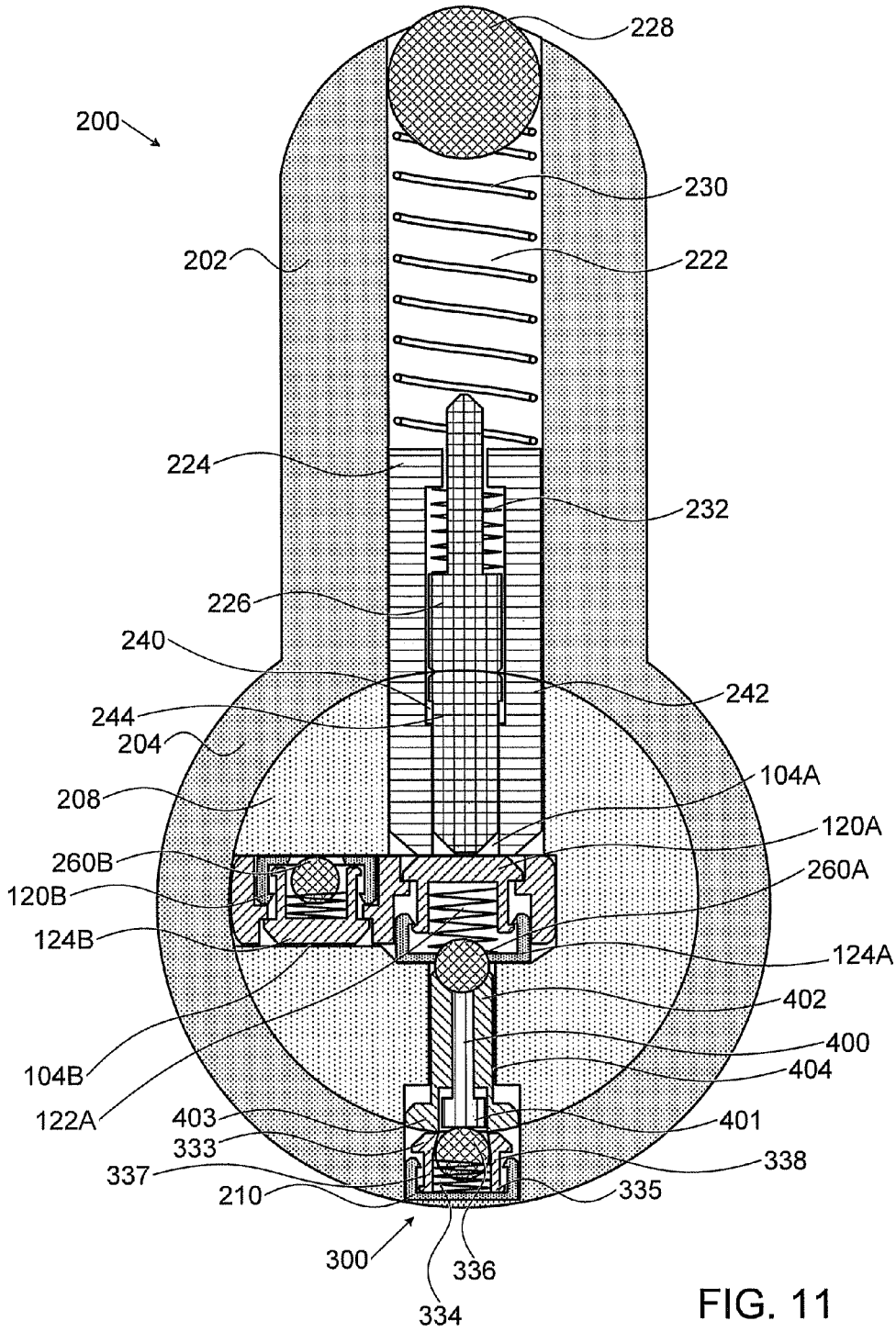
FIG. 11 illustrates a cross sectional view of a key assembly and lock assembly in which the protruding balls extend from the base of the actuation elements and the lock assembly includes a lock actuation assembly according to an embodiment of the present invention.

FIG. 11 illustrates a cross sectional view of a key assembly 100 and lock assembly 200 in which the partially protruding balls 260*a*, 260*b* extend from the base 124*a*, 124*b* of floating elements 104*a*, 104*b* and the lock assembly 200 includes a lower lock actuating assembly 300 according to an embodiment of the present invention. Similar to the embodiment illustrated in FIG. 10, the floating elements 104*a*, 104*b* may be configured to control the extent the protruding balls 260*a*, 260*b* may be outwardly biased when floating elements 104*a*, 104*b* are actuated, such as, for example, controlling the size of the aperture opening in the lower surface 131*a*, 131*b* of base 124*a*, 124*b* respectively, through which the balls 260*a*, 260*b* partially protrude.

In the embodiment illustrated in FIG. 11, when the floating element 104*a* is actuated in at the proper location along the axis of the key blade 112 aperture 109 when inserted in the lock assembly 200, the protruding ball 260*a* engages a lower pin 400. The lower pin 400 may slidingly move inside a lower housing 402. The lower housing 402 may slide in a lower bore 404 of the cylinder 208. The lower pin 400 may include a plunger 401 that engages a lower protruding ball 336 of a lock floating assembly 300. In addition to the lower protruding ball 336, the lock floating assembly 300 may include a cover 333, an actuator 334 and a base 335. The cover 333 and base 335 of the lock assembly 300 may be retained together in a manner similar to that described above with respect to the cover 120*a* and base 124*a* of the floating element 104*a* of the key assembly 100, such as, for example, the cover 333 having a lower protrusion 336 with taps 337 that engage the lips 338 of the base 335. In use, when the lock biasing mechanism 300 inwardly extends into lower bore 404 of the cylinder or the lower pin 400 or lower pin housing 402 extends into the opening 210 in the barrel, an interference is created that inhibits the rotational movement of the cylinder 208. When the proper forces are exerted on the lower pin 400, lower pin housing 402, and lock floating assembly 300, and the protruding balls 260*a*, 336 base 124*a*, and cover 333 extend the proper distance, neither the lower pin 400 and lower pin housing 402 do not extend into the opening 210 nor does assembly 300 extend in the cylinder 208 so to not inhibit rotational movement of the cylinder 208.

In one embodiment, provided herein in combination; a key assembly 100 comprising: a key blade 112, the key blade having a first surface 106 and a second surface 108, the key blade 112 configured to be inserted into a mating lock; an aperture 109 in the key blade, the aperture having an axis; a cap 120 having an outer surface 123, captured in the aperture 109 for continuous axial travel between a first limit extending out of the first surface 106 and a second limit recessed within the aperture 109; and a base 124 having an outer surface 131 captured in the aperture 109 for continuous axial travel between a first limit extending out of the second surface 108 and a second limit recessed within the aperture 109; wherein the base 124 is biased away from the cap; and a mating lock assembly 200, the lock assembly having a barrel 204, a column 202 extending from the barrel 204, and a cylinder 208 configured to rotate within the barrel 204, the cylinder 208 including a guide way 210; the column having an aperture configured to receive the sliding movement of a first pin housing 224, the first pin housing configured to receive the sliding movement of a first pin 226; the cylinder 208 including a cylinder aperture 206 configured to receive the sliding movement of a second pin housing 242, the second pin housing configured to receive the sliding movement of a second pin 244, the first pin 226 being inwardly biased against the second pin 244 so as to place the first pin 226 in the cylinder aperture 206 when the key assembly 100 is not positioned in the lock assembly 200; the key configured to outwardly bias and move the cap 120 or the base 124 against the first pin 226 when the key assembly 100 is positioned in the lock assembly 200 so that the second pin 244 and the second pin housing 242 are located inside the cylinder 208 and the first pin 226 and first pin housing 224 are located outside of the cylinder 208.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A key assembly comprising: a key blade, the key blade being substantially flat and having a first surface and a second surface, the key blade configured to be inserted into a mating lock; an aperture in the key blade, the aperture having an axis and a shelf radially disposed within the aperture; a cap having an outer surface, captured in the aperture for continuous axial travel between a first limit extending out of the first surface and a second limit recessed within the aperture; and a base having an outer surface, captured in the aperture for continuous axial travel between a first limit extending out of the second surface and a second limit recessed within the aperture, wherein the cap includes at least one lower protrusion having at least one tab and the base having at least one lip, the at least one tab configured to engage the at least one lip to limit the distance the cap and the base may be biased away from each other and wherein the lip and the tab define a circumferential channel configured to engage the shelf in the key blade aperture; and a magnet associated with the base, the cap or both, the magnet having sufficient magnetic strength to attract or repel a movable part of the key, or the lock from a locking position to an unlocking position in the lock, or in both the key and the lock.

2. A combination of a key assembly and a lock assembly:

the lock assembly having:

a barrel;

a column extending from the barrel, the column having at least two column apertures;

a cylinder configured to rotate within the barrel, the cylinder including a guide way sized and configured to receive a key blade, the cylinder including a cylinder aperture axially registered with the column aperture when the lock assembly is locked, and movable out of registration with the column aperture with the key blade to unlock the lock assembly;

a first and a second pin captured by one of the cylinder and the column, each of the first and second pins having a locking pin portion captured within the cylinder and slidable in the cylinder aperture and a locking safety pin portion captured within the column and slidable in the column aperture, the pins normally being biased to a locking position with the locking pin portion within the cylinder aperture and the locking safety pin portion within the column aperture to lock the cylinder relative to the barrel;

a magnetically influenced part associated with the first pin, the magnetically influenced part being movable responsive to a magnetic field provided in the guide way to move the first pin to an unlocking position; and a mechanically influenced part associated with the second pin, the mechanically influenced part being movable responsive to a non-magnetic force provided in the guide way to move the second pin to an unlocking position; and the key assembly comprising:

the key blade, the key blade being substantially flat and having a first surface and a second surface, the key blade configured to be inserted into the lock assembly guide way;

an aperture in the key blade, the aperture having an axis and a shelf disposed radially within the aperture;

a cap having an outer surface, captured in the aperture for continuous axial travel between a first limit extending out of the first surface and a second limit recessed within the aperture; and a base having an outer surface, captured in the aperture for continuous axial travel between a first limit extending out of the second surface and a second limit recessed within the aperture, wherein the cap includes at least one lower protrusion having at least one tab and the base having at least one lip, the at least one tab configured to engage the at least one lip to limit the distance the cap and the base may be biased away from each other and wherein the lip and the tab define a circumferential channel configured to engage the shelf in the key blade aperture; and a magnet associated with the base, the cap or both, the magnet having sufficient magnetic strength to attract or repel a movable part of the key, or the lock from a locking position to an unlocking position in the lock, or in both the key and the lock.

3. The invention of claim 2, wherein the magnetically influenced part is integral with the pin.

4. The invention of claim 2, wherein the magnetically influenced part is magnetized, and is positioned to repel the magnetic field provided in the guide way.

5. The invention of claim 2, wherein the magnetically influenced part is attracted by the magnetic field provided in the guide way.

6. The invention of claim 2, in which the magnetically influenced part is slidable within the cylinder aperture adjacent to the guide way.

7. The invention of claim 2, in which the first pin is biased into its locking position by a resilient element.

8. The invention of claim 2, in which the second column aperture is generally coaxial with the first column aperture and diametrically opposed to the first column aperture.

9. The invention of claim 1, wherein the magnet is movable normal to the direction of insertion of the key blade in the guide way.

10. The invention of claim 9, in which the previously defined magnet is further defined as a first magnet, the invention further comprising a second magnet associated with the base or the cap, the second magnet being positioned to repel the first magnet normal to the direction of insertion of the key blade in the guide way.

11. The invention of claim 2, in which the previously defined magnet is further defined as a first magnet, the invention further comprising a second magnet associated with the base or the cap, wherein the first and second magnets being movable with respect to the other magnet, the second magnet being positioned to be repelled by or repel the first magnet normal to the direction of insertion of the key blade in the guide way.

12. The invention of claim 11, wherein the repelling magnets bear between the key blade and the pin to bias the pin into its unlocking position.

* * * * *